US009234654B1

(12) United States Patent
Wang

(10) Patent No.: US 9,234,654 B1
(45) Date of Patent: Jan. 12, 2016

(54) TWINKLING HAIR BAND

(71) Applicant: Hua-Cheng Pan, Tainan (TW)

(72) Inventor: Chih-Liang Wang, Tainan (TW)

(73) Assignee: Hua-Cheng Pan, Tainan (TW)

( * ) Notice: Subject to any disclaimer, the term of this patent is extended or adjusted under 35 U.S.C. 154(b) by 0 days.

(21) Appl. No.: 14/463,653

(22) Filed: Aug. 19, 2014

(51) Int. Cl.

| | |
|---|---|
| ***F21V 21/084*** | (2006.01) |
| ***F21V 23/04*** | (2006.01) |
| ***F21L 4/02*** | (2006.01) |
| ***F21V 3/04*** | (2006.01) |
| ***F21V 33/00*** | (2006.01) |
| ***A45D 8/36*** | (2006.01) |
| *F21W 121/06* | (2006.01) |
| *F21Y 101/02* | (2006.01) |

(52) U.S. Cl.
CPC ..... *F21V 23/0407* (2013.01); *A45D 8/36* (2013.01); *F21L 4/02* (2013.01); *F21V 3/049* (2013.01); *F21V 33/0008* (2013.01); *F21W 2121/06* (2013.01); *F21Y 2101/02* (2013.01)

(58) Field of Classification Search
CPC ..... A01B 12/00; A45D 8/36; F21V 23/0407; F21V 33/0008; F21V 3/049; F21L 4/02
See application file for complete search history.

(56) References Cited

U.S. PATENT DOCUMENTS

| | | | | |
|---|---|---|---|---|
| 4,999,747 | A * | 3/1991 | Chen | A44C 15/0015 362/103 |
| 7,473,004 | B1 * | 1/2009 | Tsai | A44C 15/0015 362/104 |
| 2009/0116226 | A1 * | 5/2009 | Wang | A42B 3/245 362/105 |

* cited by examiner

*Primary Examiner* — Thomas M Sember
(74) *Attorney, Agent, or Firm* — Leong C. Lei

(57) ABSTRACT

A twinkling hair band mainly includes a band main body and a light guiding decoration coupled to the band main body, where the light guiding decoration has a base and at least two light diffuser plates. Two light-emitting elements corresponding to each light diffuser plate and a control circuit controlling each light-emitting element to wink in sequence are configured inside said base, and a power source switch for turning on and off electricity is configured on the base. Whereby, the corresponding light diffuser plate twinkles immediately when each light-emitting element winks in sequence through the coupling of the band main body and light guiding decoration so as to profit decoration to the band main body.

7 Claims, 8 Drawing Sheets

TWINKLING HAIR BAND

(a) TECHNICAL FIELD OF THE INVENTION

The present invention relates to a hair band, and more particularly to a hair band structure having a twinkling effect.

(b) DESCRIPTION OF THE PRIOR ART

The pursuit of beauty is females' nature; females always go shopping vigorously for dress-up, and what they always buy are dresses, care and cosmetic products, ornaments or hair accessories. For hair accessories, hair band, which may be used for not only hair finishing but headdress, is one of females' favorite.

A general hair band is constituted by a band main body and ornament, where the bottom face of the ornaments is adhered to the band body by thermosol, thereby allowing a decoration effect to be applied on a user when the user wears the band.

However, all conventional hair bands are almost the same in structure, without any change.

SUMMARY OF THE INVENTION

To provide a novel hair band, further to enhance the added value and taste thereto, the present invention is proposed.

The main object of the present invention is to provide a hair band having a twinkling effect, having a novel structure design, and further improving product competitiveness.

To achieve the object mentioned above, the present invention proposes a twinkling hair band, mainly including:

a band main body;

a light guiding decoration, coupled to the band main body, including a base and at least two light diffuser plates, at least two light-emitting elements spaced apart and a control circuit controlling each light-emitting element to wink in sequence being configured inside the base, the control circuit being in electric connection with a power source to provide electricity to drive each light-emitting element to illuminate and having a power source switch for turning on and off electricity, the power source switch being in electric connection with the control circuit, each light diffuser plate being a plate pervious to light having a preset thickness and model, one side of the light diffuser plate forming a light incidence face, and each light incidence face being configured above the corresponding light-emitting element, allowing light beams to be incident inside the light diffuser plate.

Whereby, when the band of the present invention is switched on, each light-emitting element winks according to the preset sequence, and the light beams can be scattered into the light diffuser plate through the light incidence face, allowing the each light diffuser plate to wink with the corresponding light-emitting element, thereby achieving a twinkling effect.

DETAILED DESCRIPTION OF THE PREFERRED EMBODIMENTS

Figure 1:
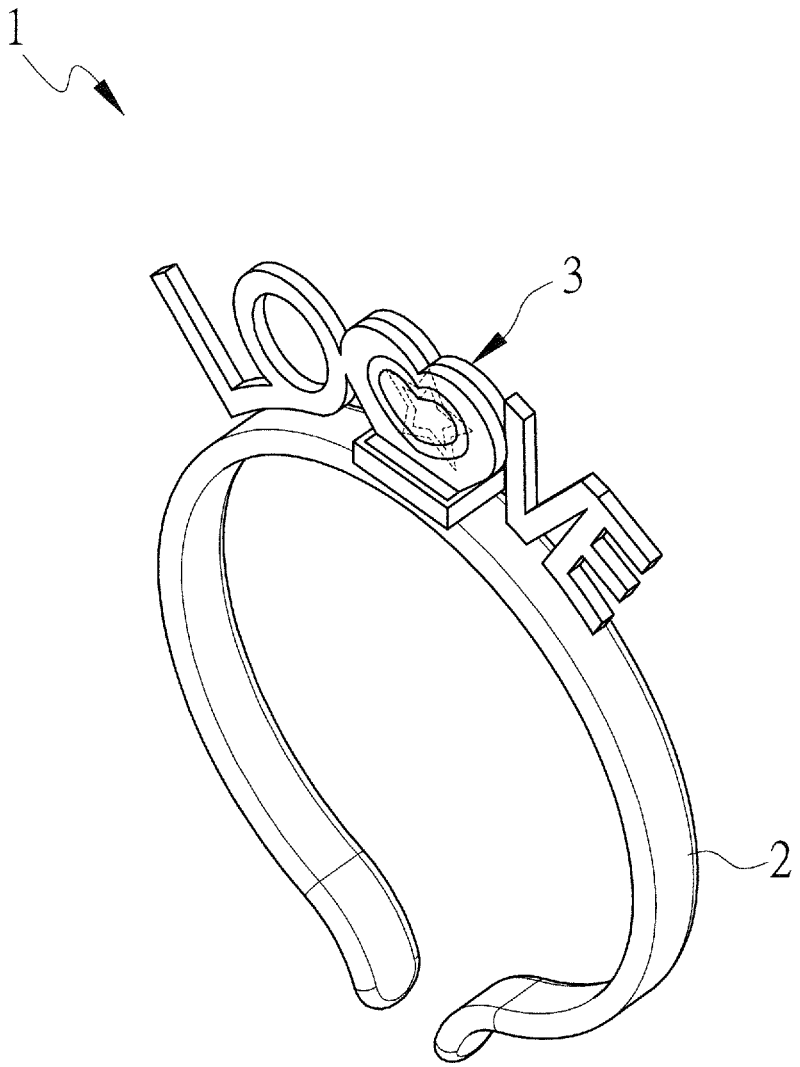
FIG. 1 is a perspective view of the present invention.
Figure 2:
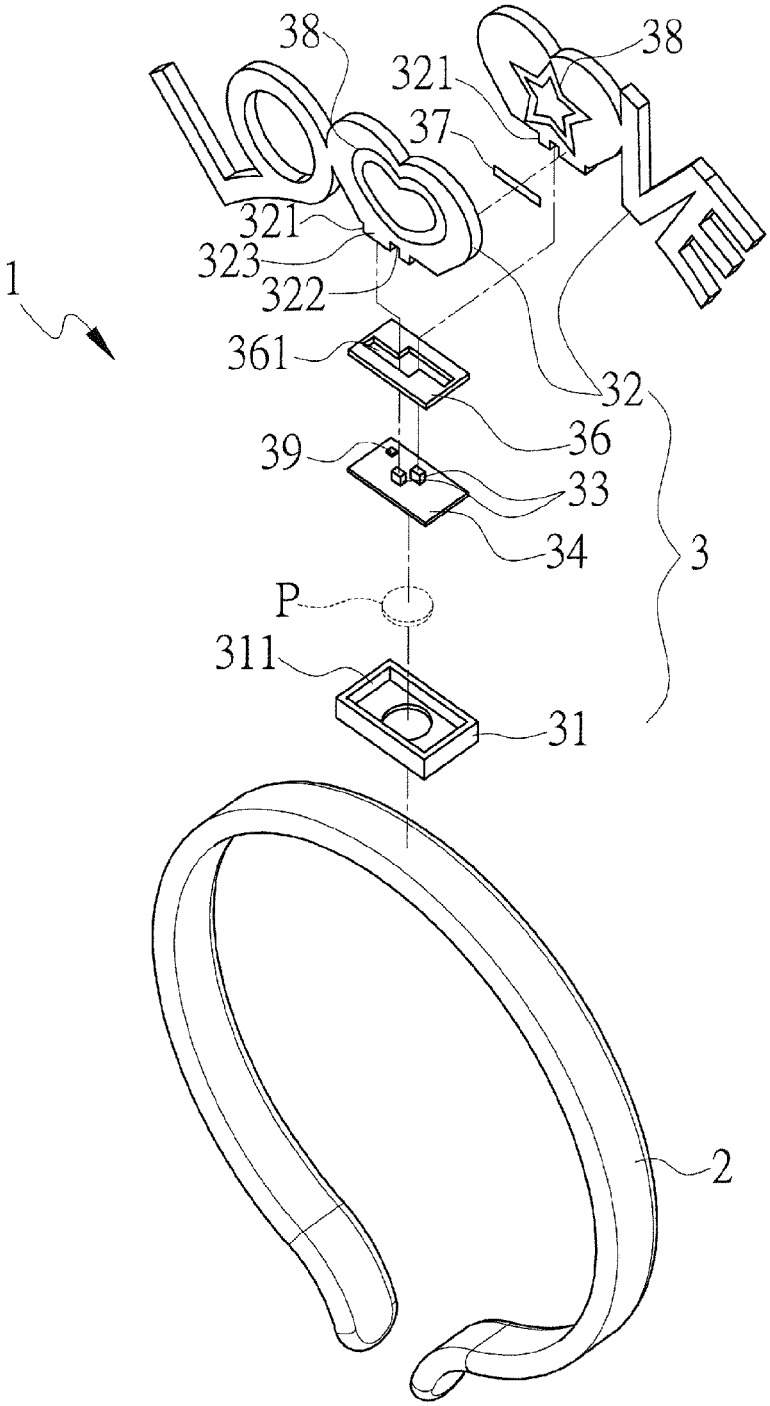
FIG. 2 is an exploded view of the present invention.
Figure 3:
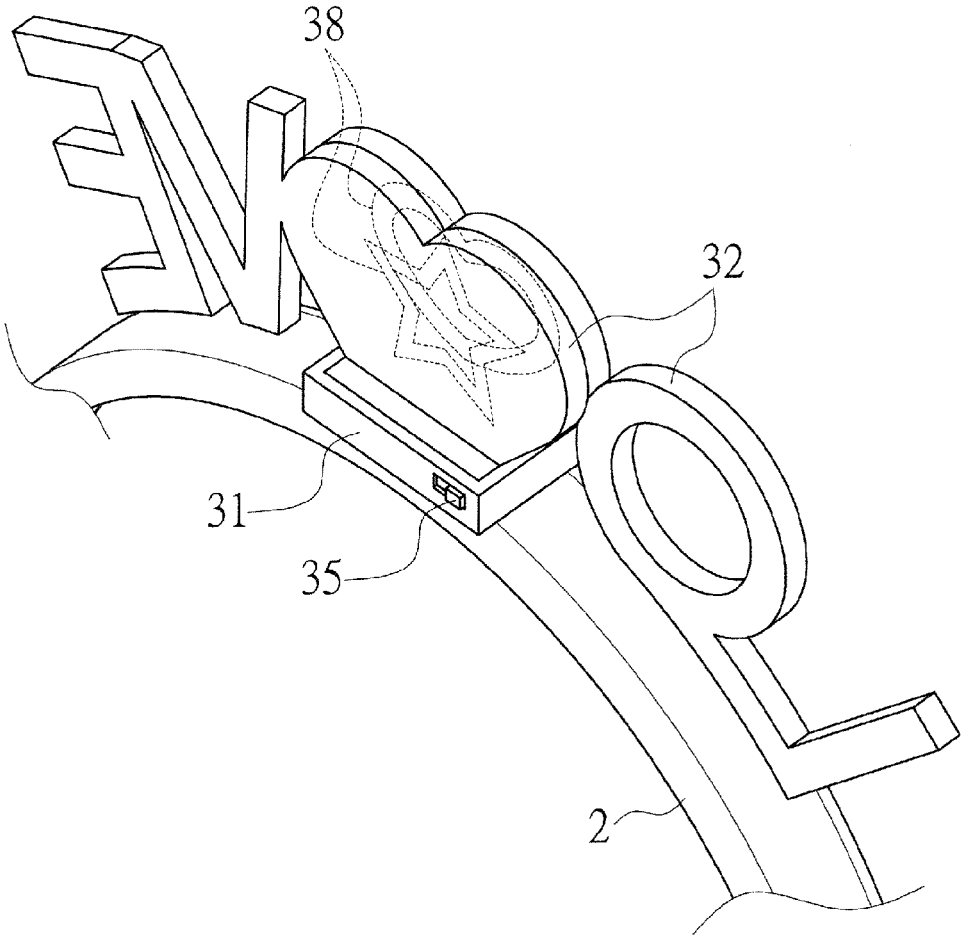
FIG. 3 is an exploded view of the present invention seeing from the rear side, where a power source switch is shown.

Referring to FIGS. 1 to 3, a twinkling hair band 1 of the present invention mainly includes a band main body 2 and light guiding decoration 3.

The band main body 2 is a flexible body, which may be made from plastics, metal, cloth covered plastics or cloth covered metal.

The light decoration 3 is coupled to the band main body 2 by means of adhesion, screwing, magnetic suction, or the like; the coupling ways are too many and not in the scope of the present invention such that the details thereof are omitted here. The light guiding decoration 3 includes a base 31 and at least two light diffuser plates 32, where the base 31 is a shell having an opening 311, and at least two light-emitting elements spaced apart and a control circuit 34 controlling each light-emitting element 33 to wink in sequence and the light color thereof. Each light-emitting element is an LED, and the number of the light emitting elements may be increased with the expansion of the number of the light diffuser plates 32; the control circuit 34 is adapted to be in electric with a power source P such as a battery to generate electricity, and further to drive each light-emitting element 33 to illuminate. Furthermore, the light decoration has a power source switch 35 adapted to turn on and off electricity and being in electric connection with the control circuit 34. Furthermore, a cover 36 adapted to seat the opening 311 is configured on the opening 311, where an assembly hole 361 is further configured on the cover 36. Here, the cover 36 is mainly used to shield the inside control circuit 34 so as to enhance the use safety.

Each light diffuser plate 32 is a plate has a preset thickness and model. In the present embodiment, the light diffuser plate 31 is words plus a heart pattern, but the present invention is not so limited to the outlook thereof. Furthermore, a light guiding portion 321 forming a light incidence face 322 is extended from one side of the light diffuser plate 32; side walls 323 are extended upward from the peripheral edge of each light incidence face 322, and a light shielding sheet 37 is configured between the adjacent side walls 323 of the two light diffuser plates 32, where the light shielding sheet 37 is made from a light tight material, mainly used for shielding the light beams of the light-emitting element 33 from being incident into the adjacent light diffuser plate 32. Furthermore, each light diffuser plate 32 is configured on the cover by inserting the light guiding portion 32 in the assembly hole 361 of the cover 36, and each light incidence face 322 is positioned above the corresponding light-emitting element 33, allowing the light beams to be incident inside the light diffuser plate 32.

Furthermore, each light diffuser plate 32 are stacked together, and for example, may be made of a material pervious to light such as glass or plastics. In addition, the light diffuser plate 32 is allowed to have color change by adding colorants during manufacturing. Moreover, the surface of each light diffuser plate 32 has a pattern, symbol, trademark, or the like, which can be formed by means of printing or carving; the pattern 38 is more eye-catching through the illumination of the light beams L when the light-emitting element 33 is lighted up.

Figure 7:
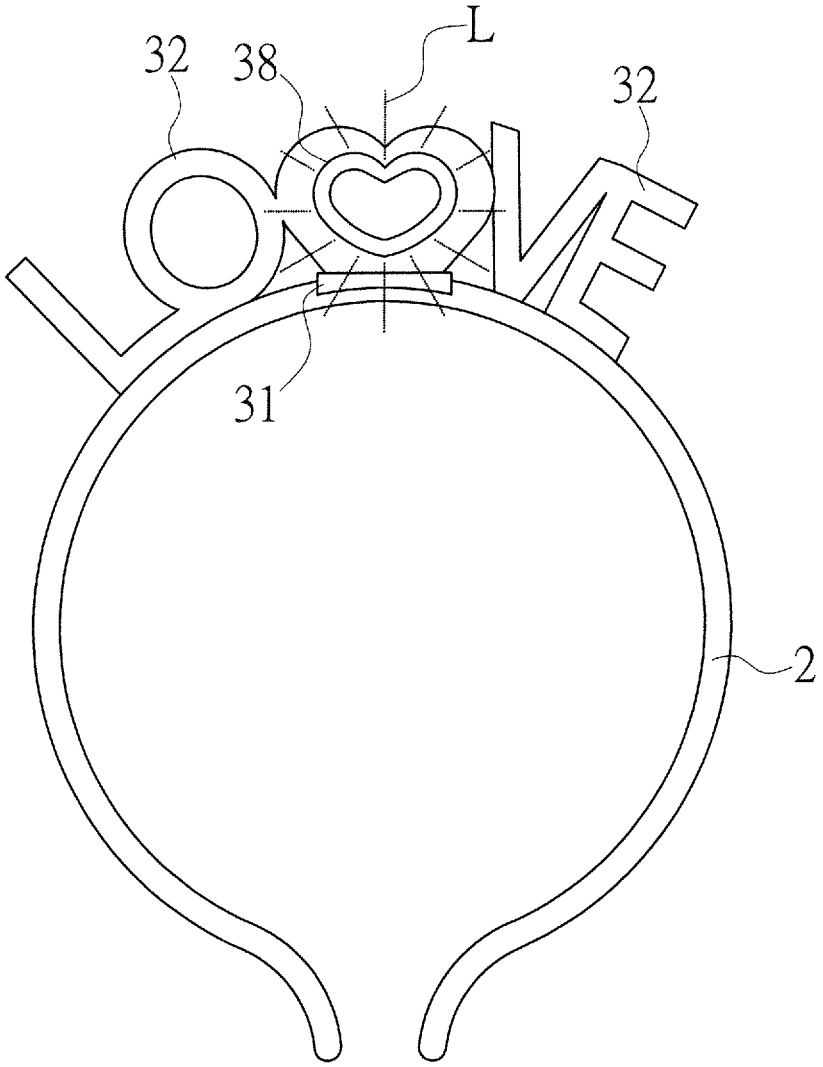
FIGS. 7 and 8 are schematic views of the present invention in a twinkling state.
Figure 8:
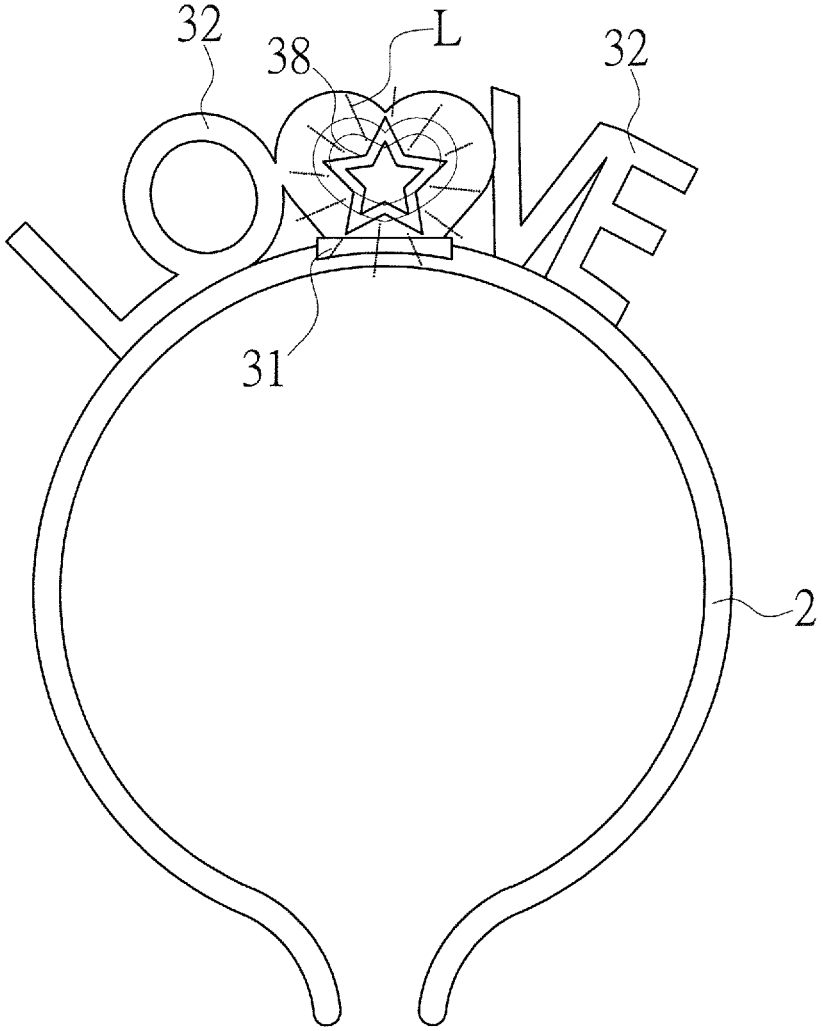

The present invention further includes a shaking switch 39 in electric connection with the control circuit 34 and power source switch 35. The shaking switch 39 can control the conduction of electricity when the power source switch 35 is normally switched on; the control way thereof is that electricity is conducted if shaking is sensed, and the electricity is interrupted if the present invention is in a static state so that the light-emitting element 33 is driven to wink in sequence to have a twinkling effect with the shaking upon walking only the power source switch 35 is switched on when the hair band of the present invention is worn on a head, and the pattern 38 configured on the surface of each light diffuser plate 32 allows the present invention to be more eye-catching due to the illumination of the light beams. In the present embodiment, the pattern 38 of each light diffuser plate 32 is different from the one of the other, as FIGS. 7 and 8 show. Therefore, each pattern 38 shows different vision feeling when each light-emitting element 33 is drive to illuminate.

Figure 4:
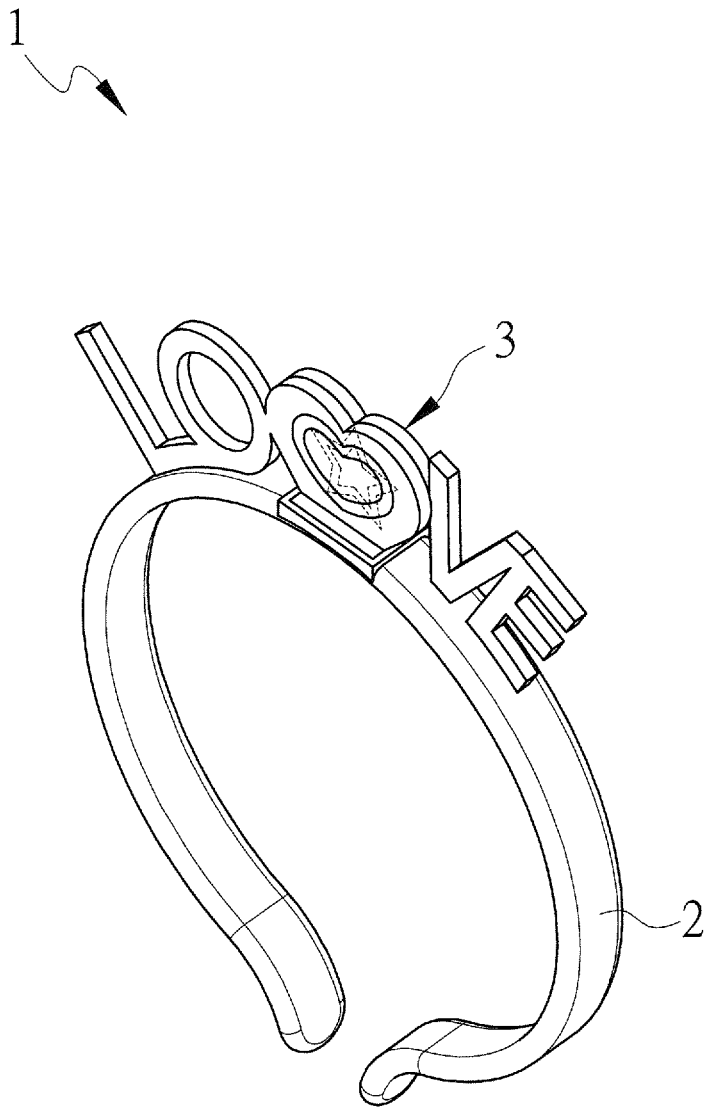
FIG. 4 is a perspective view of a preferred embodiment according to the present invention.
Figure 5:
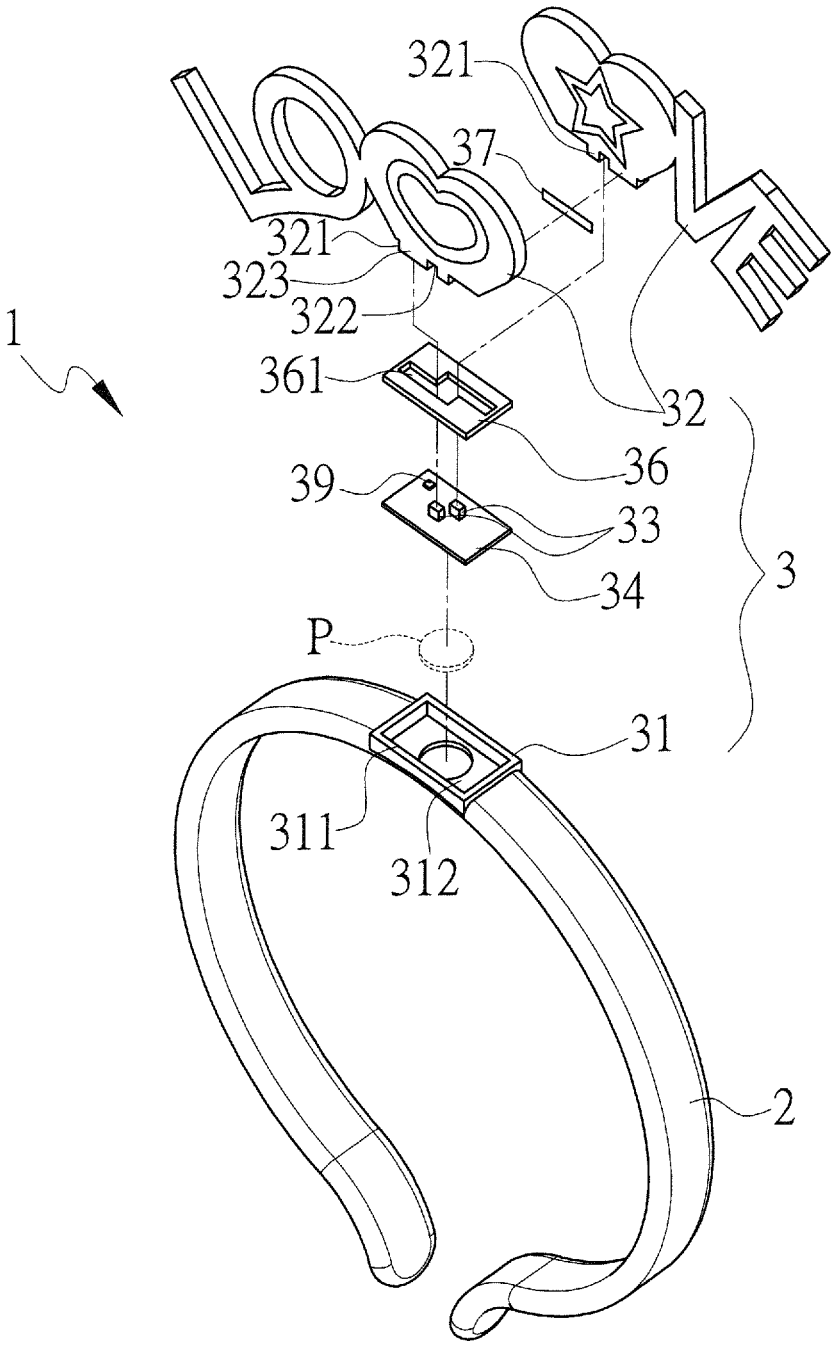
FIG. 5 is an exploded view of the present invention according to the present invention.
Figure 6:
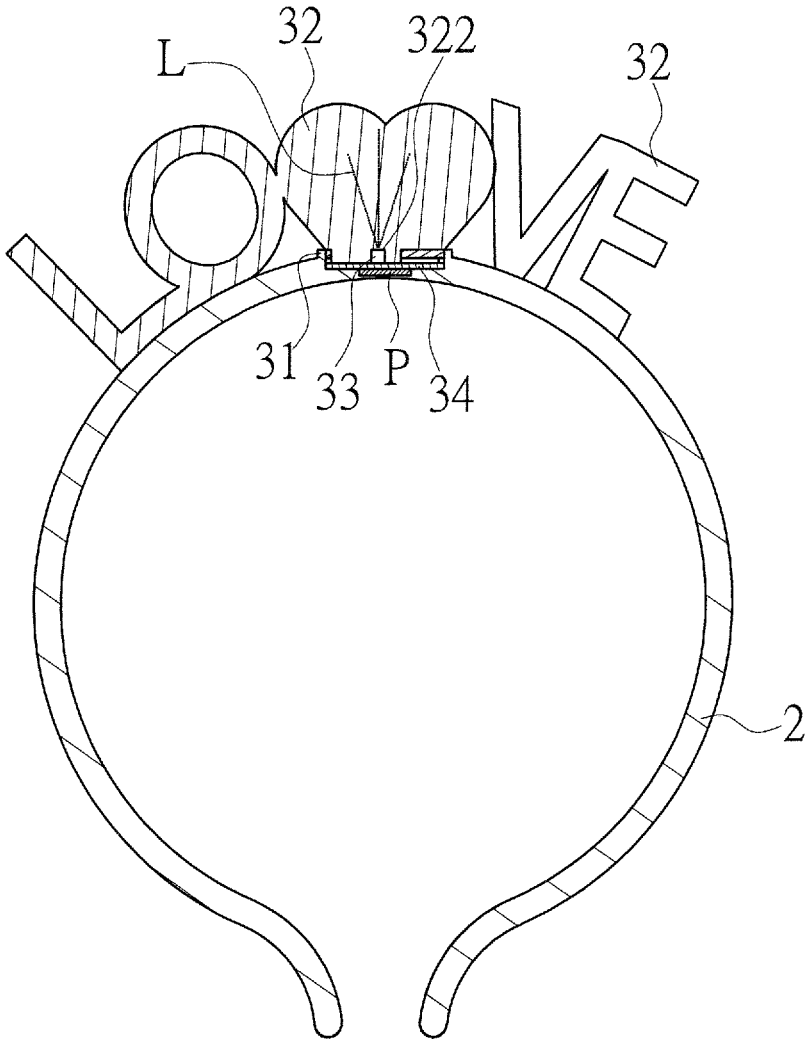
FIG. 6 is a cross-sectional view of the present invention on which the projection of light beams is schematically illustrated.

Referring to FIGS. 4 to 6, which respectively are a perspective view, exploded view and cross-sectional view of a preferred embodiment according to the present invention, the base 31 is extended out from the band main body 2 integrally, having an accepting space 312, an opening 31 in communication with the accepting space 312 and a cover 36 sealing the opening 311, where the cover 36 is configured with an assembly hole 36, and the control circuit 34, light-emitting elements 33 and battery P are configured inside the accepting space 312. Furthermore, each light diffuser plate 32 is fixed to the assembly hole 361, as such, the present embodiment is characterized in that the base 31 is extended out from the band main body 2 integrally so that the coupling of the base 32 to the band main body 2 can be done without needing other technologies.

To sum up, the present invention has the following advantages:

1. the light-emitting elements of the present invention can wink depending on a preset sequence to form a twinkling effect, and change light color to increase variability.

2. colorants may be added to form the light diffuser plate of the present invention depending on requirements during manufacturing, and the visual feeling of the present invention can be enhanced through the illumination of the light beams emitted from the light-emitting elements.

I claim:

1. A twinkling hair band, comprising:

a band main body;

a light guiding decoration, coupled to said band main body, including a base and at least two light diffuser plates, at least two light-emitting elements spaced apart and a control circuit controlling each said light-emitting element to wink in sequence being configured inside said base, said control circuit being in electric connection with a power source to provide electricity to drive each said light-emitting element to illuminate and having a power source switch for turning on and off electricity, said power source switch being in connection with said control circuit, each said light diffuser plate being a plate pervious to light having a preset thickness and model, one side thereof forming a light incidence face, and each said light incidence face being configured above said corresponding light-emitting element, allowing light beams to be incident inside said light diffuser plate.

2. The twinkling hair band according to claim 1, wherein a surface of each said light diffuser plate has a pattern.

3. The twinkling hair band according to claim 1, wherein said control circuit further comprises a shaking switch in electric connection with said control circuit and power source switch.

4. The twinkling hair band according to claim 1, wherein each said light-emitting element is controlled by said control circuit to change light color.

5. The twinkling hair band according to claim 1, wherein each said light diffuser plate is a colored plate pervious to light.

6. The twinkling hair band according to claim 1, wherein a peripheral edge of each said light incidence face is extended upward with side walls, and a light shielding sheet is configured between said side walls of said two light diffuser plates adjacent to each other.

7. The twinkling hair band according to claim 1, wherein said base is extended out from said band main body, having an accepting space, an opening in communication with said accepting space, and a cover adapted to seal said opening; said cover is configured with an assembly hole, said control circuit and light-emitting element is configured in said accepting space, and each said light diffuser plate is fixed to said assembly hole.

* * * * *